US005747073A

United States Patent [19]

Pettersson et al.

[11] Patent Number: 5,747,073

[45] Date of Patent: May 5, 1998

[54] APPARATUS FOR PRODUCING COMPOSITE CYLINDERS

[75] Inventors: Bjorn Ola Alfons Pettersson; Patrick W. Holmes, both of Huntsville, Ala.

[73] Assignee: TecSyn, Inc., St. Catharines, Canada

[21] Appl. No.: 865,742

[22] Filed: May 30, 1997

Related U.S. Application Data

[63] Continuation of Ser. No. 549,426, Oct. 27, 1995, abandoned.

[51] Int. Cl.[6] ..... B30B 11/02

[52] U.S. Cl. ..... 425/78; 425/130; 425/348; 425/405.2

[58] Field of Search ..... 425/78, 120, 123, 425/130, 405.1, 405.2, 134, 447, 348; 269/60, 72, 73, 78

[56] References Cited

U.S. PATENT DOCUMENTS

| | | | |
|---|---|---|---|
| 3,193,900 | 7/1965 | Wendt | 425/405.2 |
| 3,264,388 | 8/1966 | Roach | 425/78 |
| 3,339,234 | 9/1967 | Utz | 425/130 |
| 3,677,674 | 7/1972 | Bowles | 425/78 |
| 3,887,317 | 6/1975 | Plocher et al. | 425/130 |
| 4,370,120 | 1/1983 | Foster et al. | 425/405.2 |
| 4,564,352 | 1/1986 | Pettersson | 425/405.2 |
| 4,728,475 | 3/1988 | Beck | 264/78 |

*Primary Examiner*—Jay H. Woo
*Assistant Examiner*—Iurie A. Schwartz
*Attorney, Agent, or Firm*—John C. Garvin, Jr.; Harold W. Hilton

[57] ABSTRACT

Apparatus is disclosed for producing composite cylinders having cylinder walls comprised of two adjacent diverse layers of metal material which are bonded together by application of radial forces thereto and then sintered to complete the bonding process. Mechanical locking of the layers is achieved by grain interlocking between the two layers of metal material.

9 Claims, 7 Drawing Sheets

APPARATUS FOR PRODUCING COMPOSITE CYLINDERS

This is a continuation of application Ser. No. 08/549,426, filed Oct. 27, 1995 now abandoned.

FIELD OF THE INVENTION

This invention relates to apparatus for producing improved composite cylinders which have an inner layer of a first metallic material and an outer layer of a second metallic material. More particularly, the invention relates to apparatus for producing such composite cylinders which are suitable for use as cylinder liners in combustion engines or in bearing applications.

BACKGROUND OF THE INVENTION

It is known in the prior art to form composite metal cylinders by positioning first and second powdered materials in a mold cavity with the powdered materials in coaxial relation and having a divider ring or partition between the two powdered materials. The powders are then isostatically pressed to form a cylinder having inner and outer walls comprised of different materials. A prior art patent which discloses such composite metal cylinders is U.S. Pat. No. 4,721,598 issued on Jan. 26, 1988, to Peter W. Lee.

Another prior art patent which discloses such composite metal cylinders is U.S. Pat. No. 5,069,866 issued on Dec. 3, 1991 to Ragnar Ekbom for "Method For Manufacturing A Compound" first and second powders and upon being isostatically compacted and sintered the partition material becomes a part of the finished cylinders. No transitional layer of bonding material comprised of an intermixture of the compacted powders is used.

The present invention eliminates the need for partitions and divider rings and provides a transitional bonding layer of material between inner and outer layers of the formed cylinder. The transitional bonding layer is characterized by being of the same materials that are bonded together to form the cylinder.

Some internal combustion engines known in the art include engine blocks which are provided with a cylinder made of cast iron or an aluminum alloy cylinder into which a cylinder liner made of cast iron is inserted.

It has been well recognized that an internal combustion engine cylinder should be comprised of a material that is highly resistant to wear, is light in weight, has a good thermal conductivity and good machinability. However, as is well known, that cast iron cylinders used as cylinder liners for internal combustion engines which are available in the prior art are relatively expensive, heavy in weight and have poor thermal conductivity, though it has relatively good wear resistance. Also, aluminum alloy cylinder liners of the prior art, while relatively light in weight and possessing a relatively good thermal conductivity is easily liable to wear. Copper, like the aluminum alloys, possesses good thermal conductivity but is also easily liable to wear.

The cylinder of the present invention combines the best qualities of iron, i.e., durability and good wear resistance with the best qualities of aluminum or copper, i.e., lightweightness and good thermal conductivity to form a composite of iron and iron or iron and aluminum or a composite of iron and copper to provide a lightweight, wear resistant, relatively inexpensive cylinder having good thermal conductivity. Composites may also be formed of aluminum and copper, if desired.

It is an object of the present invention to provide a powdered metal composite cylinder.

It is a further object of the present invention to provide such a cylinder in the shape of a cylinder liner for internal combustion engines.

It is still a further object of the present invention to provide apparatus for manufacturing such composite powdered metal cylinders.

It is yet a further object of the present invention to provide a method for manufacturing such powdered metal cylinder liners.

A salient feature of the present invention is that diverse metals are positioned in a pressure chamber in at least two contiguous, coaxial, annular columns. Pressure is then radially applied against the contiguous columns to provide a good bond between the diverse metallic columns to form a cylinder therefrom and the cylinder is then sintered at predetermined temperature for a predetermined time.

In the case of cylinder liners for internal combustion engines, it can be readily appreciated that the inner surface of the cylinder is formed of the more dense, wear resistant material which comes in contact with the piston rings, and the outer thermal conductive surface is formed from the lower density, a less expensive material.

Some typical combinations of metals as used herein include Al/Fe, Al/Cu, Cu/Fe, or $Fe_{(1)}/Fe_{(2)}$ where $Fe_{(1)}$ consists of powdered iron having a grain size of about −60 to −80 mesh and $Fe_{(2)}$ consists of iron having a grain size of about −100 to −150 mesh.

DESCRIPTION OF THE PREFERRED EMBODIMENTS

Figure 1:
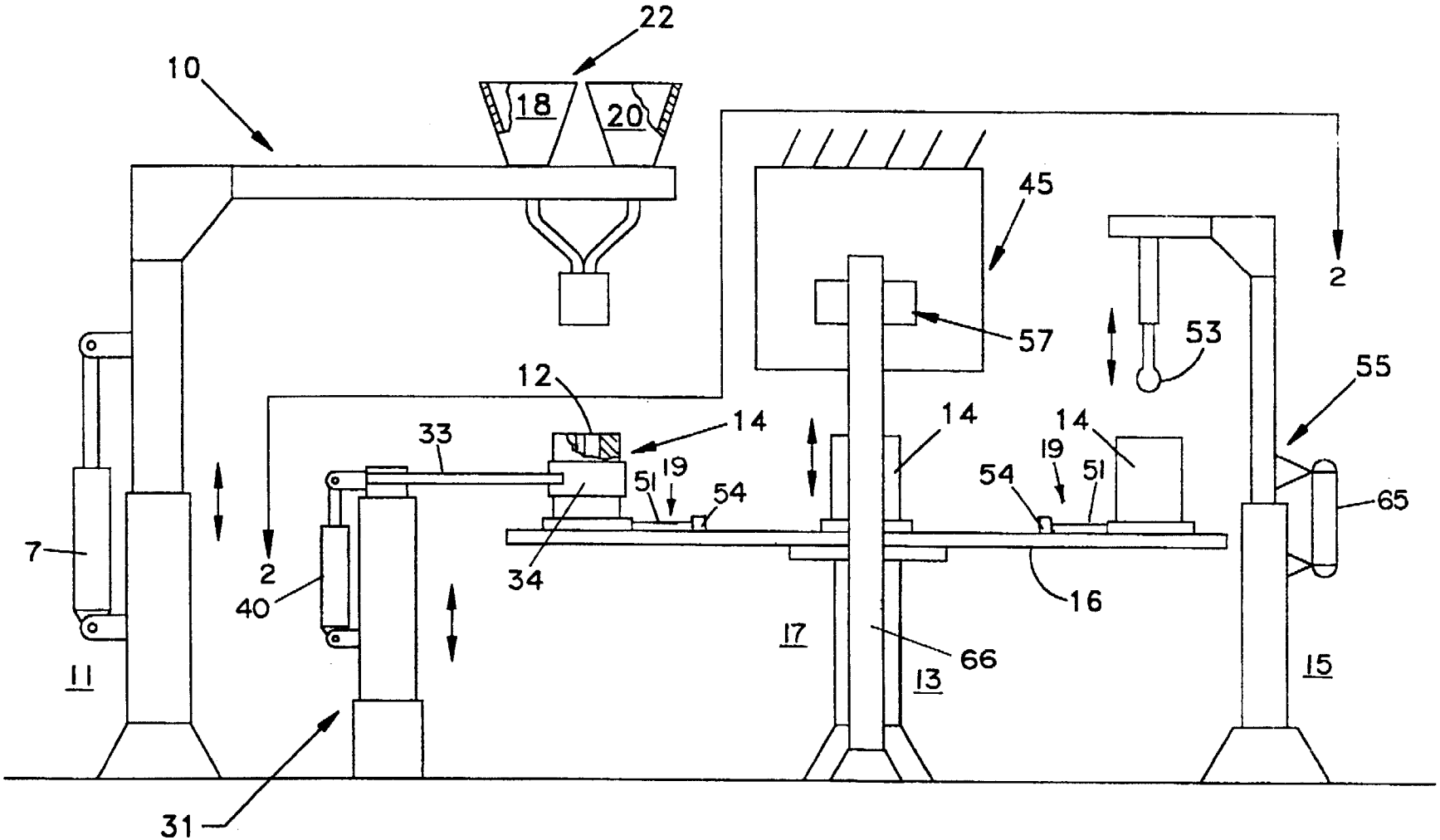
FIG. 1 is an elevational diagrammatic view of the powdered metal compaction apparatus of the present invention. A powdered metal supply and feeder mechanism is shown positioned above a molding tool.

In carrying out the principles of the present invention, apparatus 10 (FIGS. 1 and 2) is provided for moving one of a plurality of molding tools 14 which is positioned on sliding trays 19 carried on a turntable 16 (rotatable by any of many rotation imparting means known in the art) beneath a powdered metal feeding device 22 so that the feeding device 22 can feed powdered metal into a cavity 12 of molding tool 14.

Figures 2, 2A, 2B, 2C:
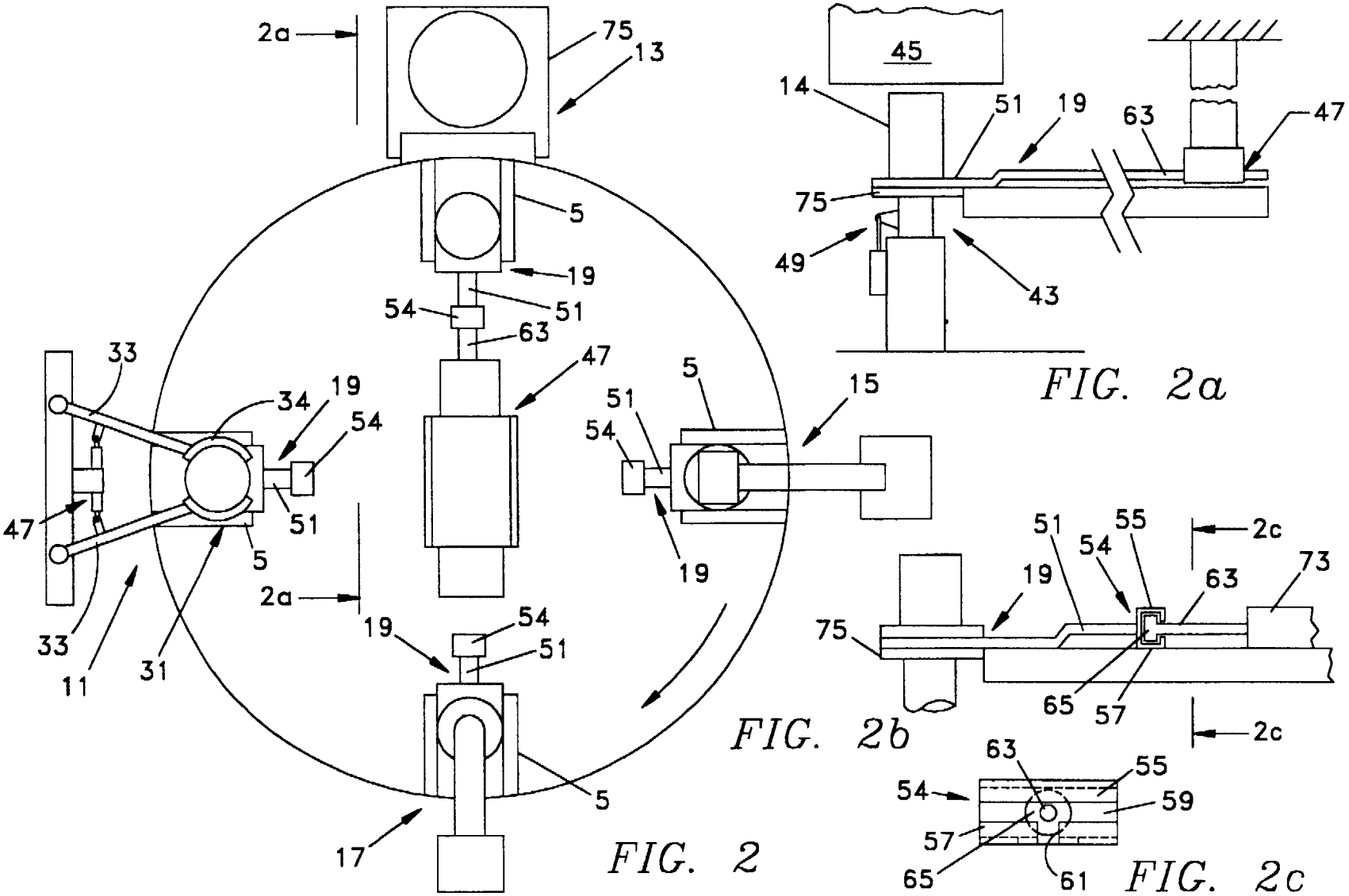
FIG. 2 is a plan view of the apparatus of FIG. 1.
FIG. 2*a* is an elevation view as seen along 2*a*–2*a* of FIG. 2 illustrating the lifting apparatus for raising the molding tool into the press wherein compacting of the adjacent metals in the molding tool is made to occur. The Figure also illustrates mechanism for moving the molding tool into position beneath the press.
FIG. 2*b* is an enlarged elevational view of the actuator for moving the molding tool into position beneath the press.
FIG. 2*c* is a sectional view taken along line 2*c*–2*c* of FIG. 2*b*.

The apparatus 10 is shown, in FIG. 2, to include around the periphery of turntable 16, a powder filling station 11, a pressurizing station 13, a cylinder removal station 15 and a mold cleaning station 17. The powder filling station 11 is the position wherein powdered metal is poured into the cavity of the molding tool 14. The turntable rotates the filled molding tool to the pressurization station where pressure is applied against the molding tool by a press 45 to form a cylinder. Turntable 16 then rotates the compacted cylinder to the cylinder removal station 15 where the formed cylinder is removed from the molding tool to be placed in a furnace. Upon continued rotation of turntable 16, the empty molding tool is then positioned at cleaning station 17 where a vacuum device removes any remaining powders from the molding tool.

FIG. 1 illustrates the use of a pair of hoppers 18 and 20 for discretely storing a pair of diverse powdered metals for reasons explained hereinbelow. However, in certain applications only one powdered metal is used and if only one powdered metal is used (for reasons explained hereinbelow) in forming the cylinder of the present invention, only one hopper is necessary. The apparatus 10 may be automatically controlled.

Figure 8:
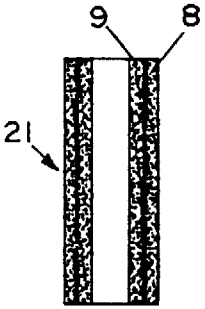
FIG. 8 is a sectional view of a cylinder formed according to the principles of the present invention.

FIG. 8 illustrates a cylinder 21 produced by the apparatus method of the present invention. The cylinder includes a cylinder wall which is formed of two layers 8 and 9. The layers may comprise, in one embodiment, two iron based powders which may differ in grain size. The grain size of the first iron based material ($Fe_{(1)}$) may, by way of example, be on the order of −60 mesh and the grain size of the second iron based material ($Fe_{(2)}$) may be on the order of −100 mesh. When forming a cylinder of $Fe_{(1)}$ and $Fe_{(2)}$ in accordance to the principles of the present invention, it is necessary to feed the two different materials into annular cavity 12 of molding tool 14 in such a manner as to form two unmixed, annular, powder columns in coaxial, contiguous relation around a mandrel which forms a part of the molding tool 14 (see FIGS. 6 and 7). Since larger mesh size iron powder is generally less expensive than the more dense smaller mesh size iron powder, a less expensive iron cylinder is made by combining the two iron based powders. When the cylinder is used as a cylinder liner in internal combustion engines, the more dense layer is provided on the interior of the cylinder. A bonding layer comprised of the powdered metals only is formed between the two layers and mechanically lock the layers together since small portions of each powdered metal will be integrated into each other (grain interlocking) during the compacting and sintering cycles of the forming procedure.

Figure 7:
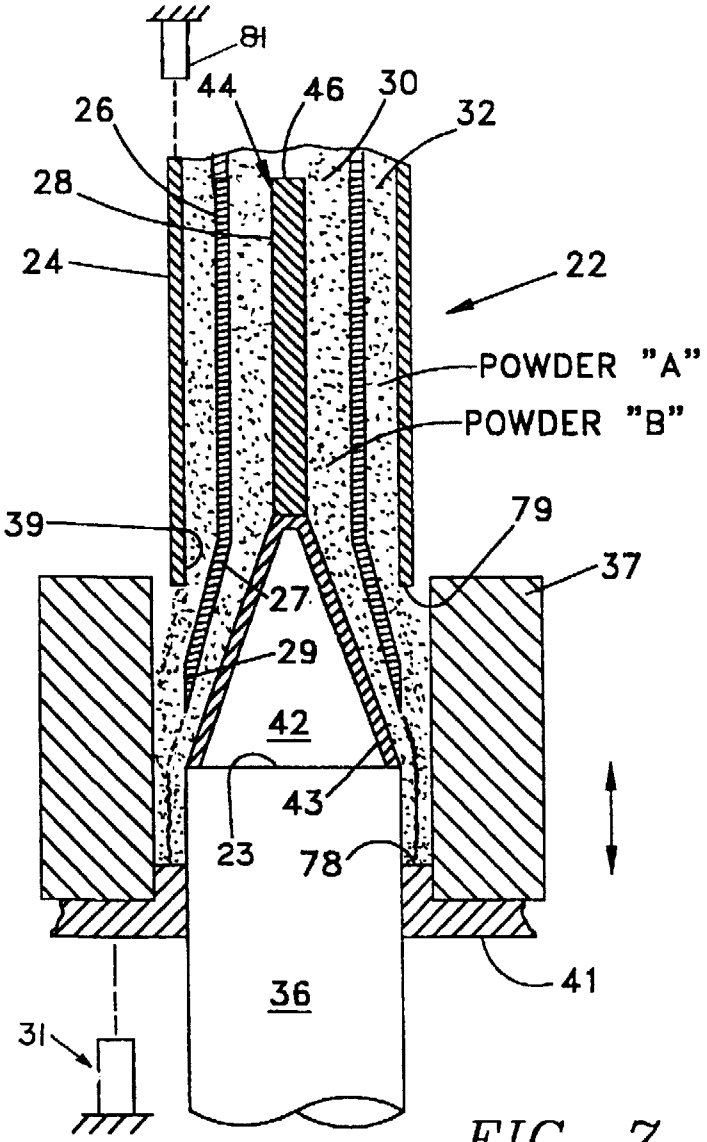
FIGS. 6 and 7 are partial sectional views of the powder feeding device and illustrates the method for loading the powdered metals into the molding tool in contiguous columns.
Figure 6:
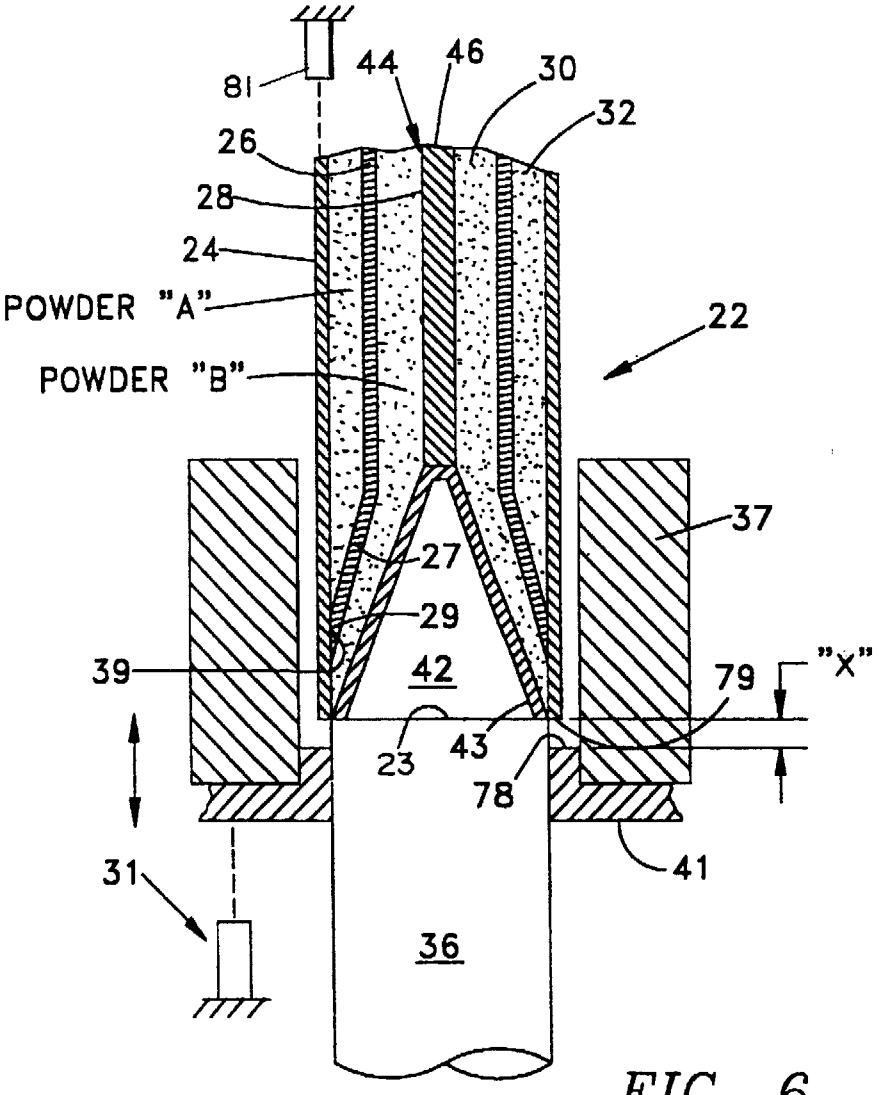

As seen in FIGS. 6 and 7, feed device 22 includes a valve assembly 44 comprising a plurality of spaced concentric annular walls 24, 26 and 28 forming powder receiving cavities 30 and 32 therebetween. Wall 28 is formed by a stem 46 having a lower conical portion 42 which is provided with lower surface 43 for engagement with an upper surface 23 of a mandrel 36. Inner wall 26 is provided with a lower conical portion 27 having a lower surface 29 which engages an inner lower surface 39 of outer wall 24.

Molding tool 14, (FIGS. 3, 4 and 5), includes a base 76 which supports the mandrel 36 thereon. An elastomeric forming mold 37 member, having a cavity 35 therein, is mounted to an annular support member 41. Base 76, mandrel 36, and support member 41 are mounted for vertical movement in forming mold member 37. The molding tool 14 is disposed for insertion into a press 45 after being filled by powdered metals from device 22. The press 45 and the molding tool 14 is somewhat similar to that disclosed in U.S. Pat. No. 4,564,352, issued to Ola Pettersson on Jan. 14, 1986 for "Apparatus For Compensating Axial Strain In An Isostatic Press" and incorporated herein by reference.

Figure 4:
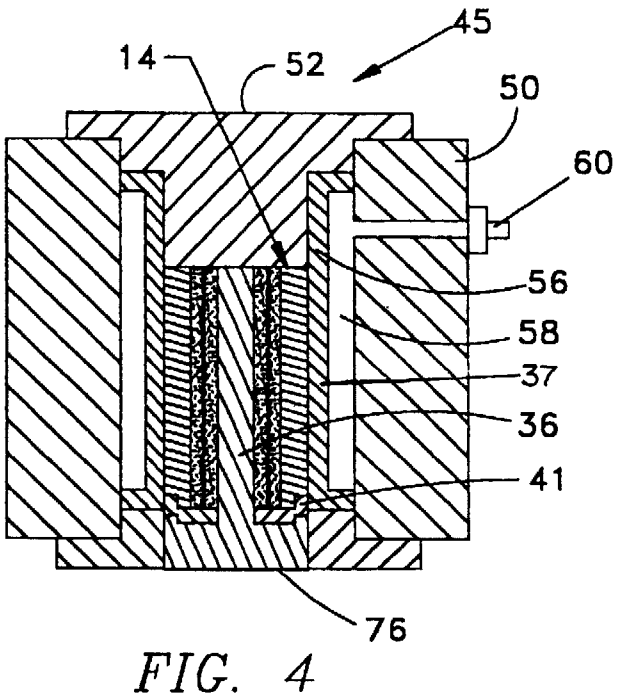
FIG. 4 is a sectional view of the press and molding tool in assembled relation.
Figure 5:
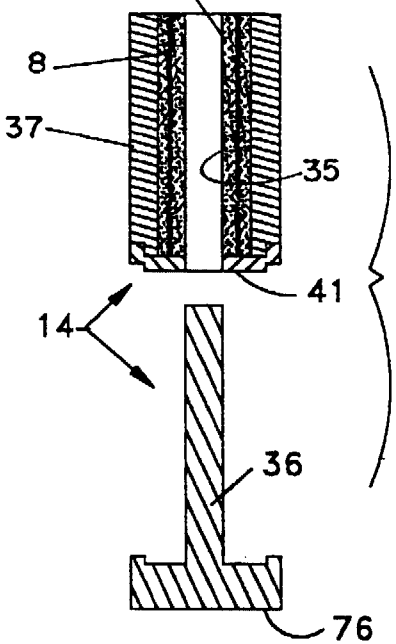
FIG. 5 is a sectional exploded view of the molding tool.
Figure 3:
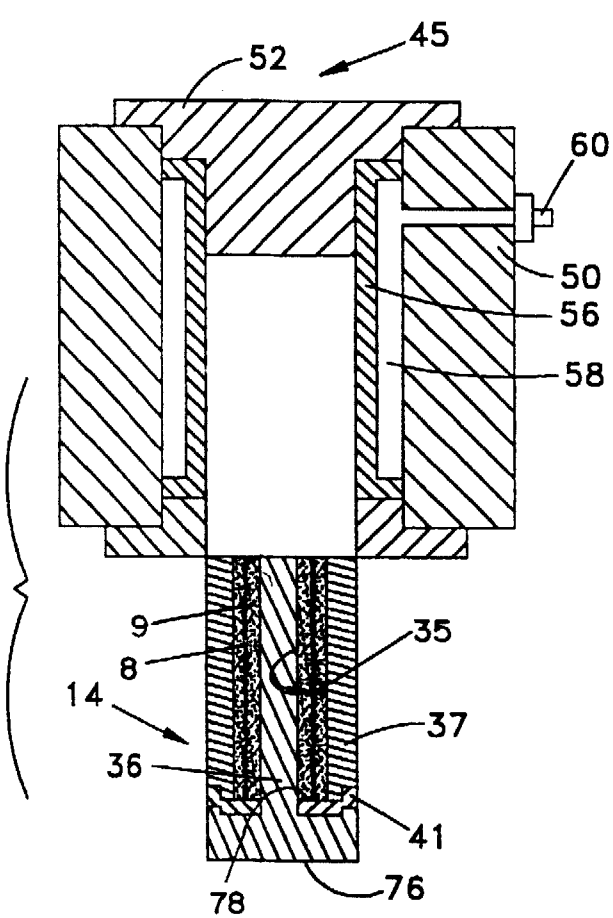
FIG. 3 is an exploded sectional view of the molding tool of the present invention partially inserted into a press for compacting the contiguous columns of metals in the molding tool.

FIG. 5 illustrates molding tool 14 and FIGS. 3 and 4 illustrate press 45 of the present invention which includes a cylindrical jacket 50 with a fixed end structure 52. On its inside, the jacket 50 has an elastomeric annular jacket 56 and an annular hydraulic chamber 58 is provided between jacket 50 and elastomeric jacket 56. The chamber 58 is pressurized via a pressurization and vent line 60.

With the molding tool 14 filled with two diverse metals such as $Fe_{(1)}$ and $Fe_{(2)}$ as discussed supra, it is inserted into press 45 as seen in FIG. 4, and pressure (typically hydraulic) is directed into chamber 58 through member 60 to apply pressure against forming mold 37 which in turn exerts pressure against the powdered metals carried in annular chamber 35 (mold cavity) between elastomeric member 37 and mandrel 36. The pressure compacts the two different metals into the configuration shown in FIG. 8.

FIGS. 6 and 7 illustrate the filling procedure. As seen in FIG. 6 which illustrates the beginning of the filling process, the conical end surface 43 of stem 46 is positioned against the top surface 23 of mandrel 36. The tool guide support member 41 and forming mold member 37 of molding tool 14 is raised upwardly to a point wherein an inner annular surface 78 of the tool guide support member 41 is at a predetermined distance (designated by the letter X) from the bottom surface 79 of vertically movable sleeve or wall 24, at which time filling begins.

To raise the tool guide support member 41 and forming mold member 37 to this position a lifting assembly 31 is provided at the powder filling station 11 (FIGS. 1 and 2) and includes a pair of movable arms 33 (FIG. 1) having gripping surfaces 34 thereon to grip the tool guide support member 41 and forming mold member 37 for vertical movement thereof relative to the mandrel 36 and the mandrel base 76 which remains on the turntable. An actuator 40 (FIG. 1) is provided to vertically move the arms 34. An actuator 47 is provided to move the gripping surfaces 34 into gripping engagement with the movable guide support member 41 and forming mold member 37. While fluid actuators 40 and 47 are disclosed as the fluidic actuating mechanisms, it is to be understood that electric motors may be utilized, if desired.

While in the position shown in FIG. 6, vertically movable outer sleeve 24 is moved upwardly by an actuator 81 at the same time that tool guide member 41 is moved downwardly by mechanism 31. The powders are loaded into the cavity 35 in side-by-side, annular, contiguous relation as the tool guide support member 41 is moved downwardly carrying the forming mold 37 with it, until the configuration illustrated in FIG. 7 is reached. Powder flow is then terminated.

The filled mold is then placed in the pressure vessel 45 and then pressurized by hydraulic pressure flowing through fill valve 60 into the hydraulic chamber 58 thereby radially acting the two columns of metal together into a single mass in the form of a cylinder (FIG. 8). For $Fe_{(1)}$ and $Fe_{(2)}$ the compacting pressure is on the order of 50,000–90,000 PSI. (Preferably on the order of about 60,000 PSI).

In the operation of the apparatus, a molding tool 14 is positioned at the powder filling station 11 where it is filled with powdered metal. FIG. 1 illustrates two hoppers for filling the molding tool. It is important, according to the principles of the present invention, that the metals be positioned in the mold cavity at a predetermined orientation wherein the powdered metals form contiguous, concentric, annular columns.

To place the filled mold in the pressure vessel the turntable in rotated to be positioned at the pressurization station 13 beneath the pressure vessel 45. As seen in FIG. 2, a plurality of tool trays 19 are positioned in equally spaced relation in guide members 5 on the table 16. The molding tools 14 are placed on the tool trays 19. After one of the molding tools 14 has been loaded with the diverse metals at station 11, table 16 is rotated to position the loaded molding tool and tool tray 19 under the press 45. As seen in FIGS. 2, 2*a* and 2*b* each tool tray 19 includes an extending portion 51 having a tray claw 54 (FIGS. 2*a*–2*b*) on the distal end thereon. Claw 54 is formed by an upper portion 55 and lower portion 57 having a space 59 therebetween. As seen in FIG. 2*c* lower portion 57 is provided with a cutout portion 61. An actuator 73 (hydraulically actuated solenoid, controlled piston or an electric motor) having an arm 63 provided with an annular enlarged shoulder 65 disposed on the distal end thereof is provided to move molding tool 14 underneath the press 45. As the molding tool rotates around the table and approaches the pressing station 13 the shoulder 65 moves into the space 57 of the claw 54. The actuator arm 63 pushes the tool tray onto an elevatable press table 75 under the press 45. The tool tray 19 remains in this extended position during the pressing operation. To position the molding tool into press 45, the press table 75 is elevated by actuator 49 to lift the molding tool into press 45. After pressing is completed, the tool tray is lowered. To permit the tool tray to be lowered and to be rejoined with arm 63, the lower portion 59 of claw 54 is provided with a cut-out portion 61. The cut-out portion 61 moves downwardly over arm 63 and shoulder 65 into the tool claw 54. While in tool claw 54 the enlarged shoulder 65 engages the interior surfaces of upper and lower members 54 and 57 to provide linear movement to the tool tray and the molding tool. Continued rotation of table 16 moves the shoulder 65 from the space between upper portion 55 and lower portion 57 of claw 54 to permit the molding tool to be moved to the next station 13. The tool tray remains in the same position relative to table 16 by being retained in guide members 5 as seen in FIG. 2, and shoulder 65 slides through one side of claw 54 and out the other side of claw 54 responsive to rotation of table 16.

The turntable is then rotated to the cylinder removal station 15 where the cylinder is removed from the molding tool. To remove the cylinder, an inflatable member 53 (FIG. 1) is moved downwardly by a vertically movable support structure 55 and is inserted inside the cylinder and inflated so as to grip the inner wall of the cylinder. Member 53 is then raised for removal from the molding tool. The support structure may be vertically movable by a hydraulic actuator 65 or electric motor, as desired. The turntable then rotates the molding tool to cleaning station 17 where a vacuum cleaning apparatus 57 (FIG. 1) is lowered by a vertically movable support 66 to vacuum out any remaining powdered metals. The vertically movable support 66 may be movable by fluid actuators or electric motors, as desired.

Figure 9:
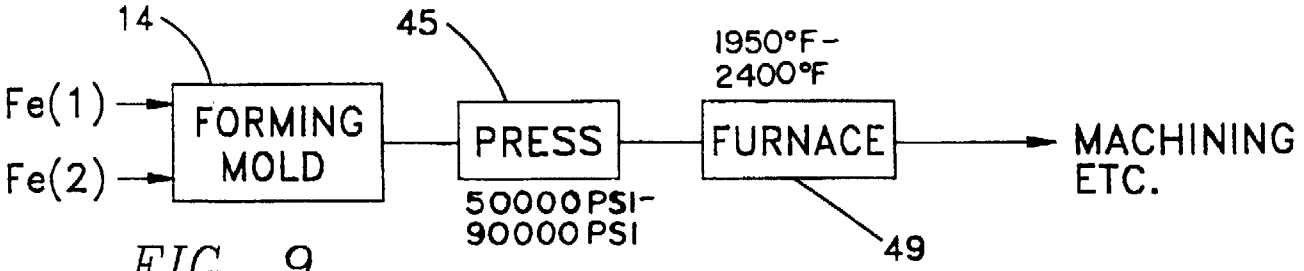
FIG. 9 is a block diagram of the method for forming a cylinder of two dissimilar iron based powdered metals wherein the iron based powdered metals are dissimilar in that they are of different grain size.

After the compacting process is completed (in the case of $Fe_{(1)}$ and $Fe_{(2)}$) the formed cylinder is placed in a furnace 49 FIG. 9) where it is sintered at temperatures in the range of 1950° F. to 2400° F. for a period of 20–60 minutes. After sintering, the cylinder is then cooled to room temperature after which any desired or required machining is accomplished.

While the above discussion has been directed to powdered $Fe_{(1)}$ and $Fe_{(2)}$ it is to be understood that combinations of other metal powders may be resorted to. Of course, the sintering temperatures and forming pressures resorted to depends on the choice of metals to be compacted and sintered.

Figure 10:
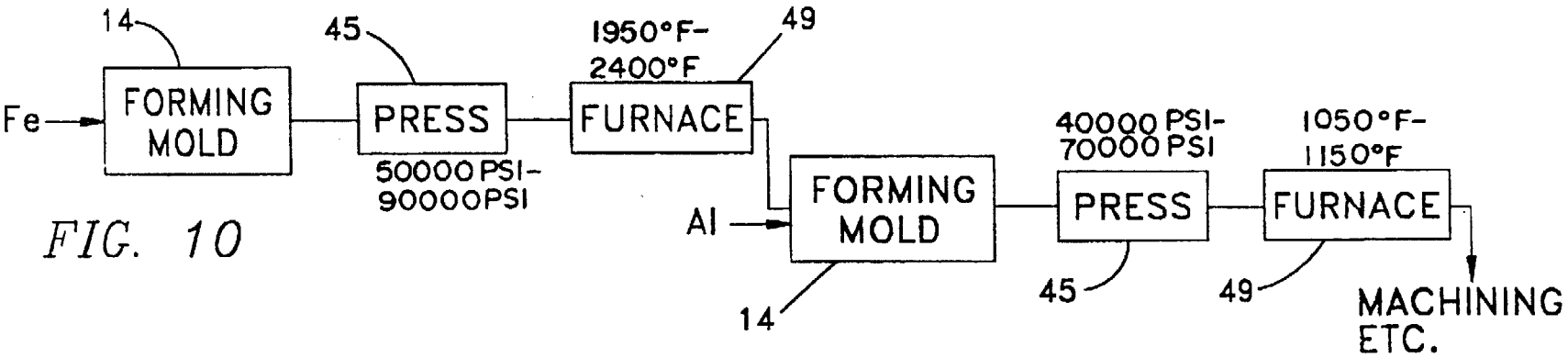
FIG. 10 is a block diagram for forming a cylinder of a preformed sintered Fe cylinder and Al powder.

The method for forming a cylinder made of Fe powder and a preformed sintered Al cylinder is illustrated in the block diagram of FIG. 10. As seen in FIG. 10, powdered Fe is placed in forming mold 14 and compacted by press 45 at about 50,000–90,000 PSI (preferably 60,000 PSI). The formed, compacted cylinder is then placed in furnace 49 where it is sintered at about 1950°–2400° F. for about 20–60 minutes.

After the cylinder has been sintered and allowed to cool, it is then placed back in the mold 14 and powdered aluminum is added to form two contiguous columns. One column is the sintered Fe cylinder and the second column is the powdered Al. The mold is then placed in the press and is pressurized at about 40,000–70,000 PSI to compact the powdered Al and to bond and interlock the powdered Al to the formed Fe cylinder. The cylinder is then placed in furnace 49 where it is sintered at about 1050°–1150° F. for 20–60 minutes. It is to be understood that the powdered Al may be bonded to the interior or exterior surfaces of the iron cylinders, as desired.

Figure 11:
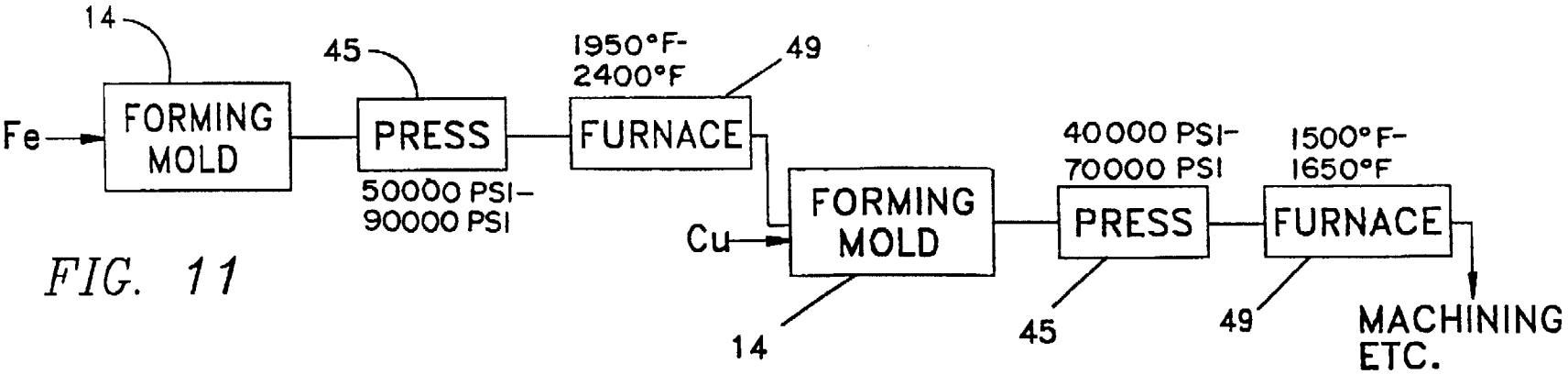
FIG. 11 is a block diagram for forming a cylinder of a preformed sintered Fe cylinder and Cu powder.

The method for forming a cylinder of powdered iron and a preformed sintered Cu cylinder is illustrated in the block diagram of FIG. 11. As seen in FIG. 11, powdered Fe is placed in forming mold 14 and compacted by press 45 at about 50,000–90,000 PSI, (preferably 60,000 PSI). The formed, compacted cylinder is then placed in furnace 49 where it is sintered at about 1950°–2400° F. for about 20–60 minutes. After the cylinder has been sintered and allowed to cool, it is then placed in the mold 14 and powdered Cu is added to form two contiguous columns. One column is the sintered Fe cylinder and the second column is the powdered Cu. The mold is then placed in the press 45 and is pressurized at about 40,000–70,000 PSI (preferably 60,000 PSI) to compact the powdered Cu and to bond the powdered Cu to the formed Fe cylinder. The cylinder is then placed in furnace 49 where it is sintered at about 1500°–1650° F. (preferably 1550° F.) for 10–20 minutes. It is to be understood that the powdered Cu may be bonded to the interior or exterior surfaces of the iron cylinder, as desired.

Figure 12:
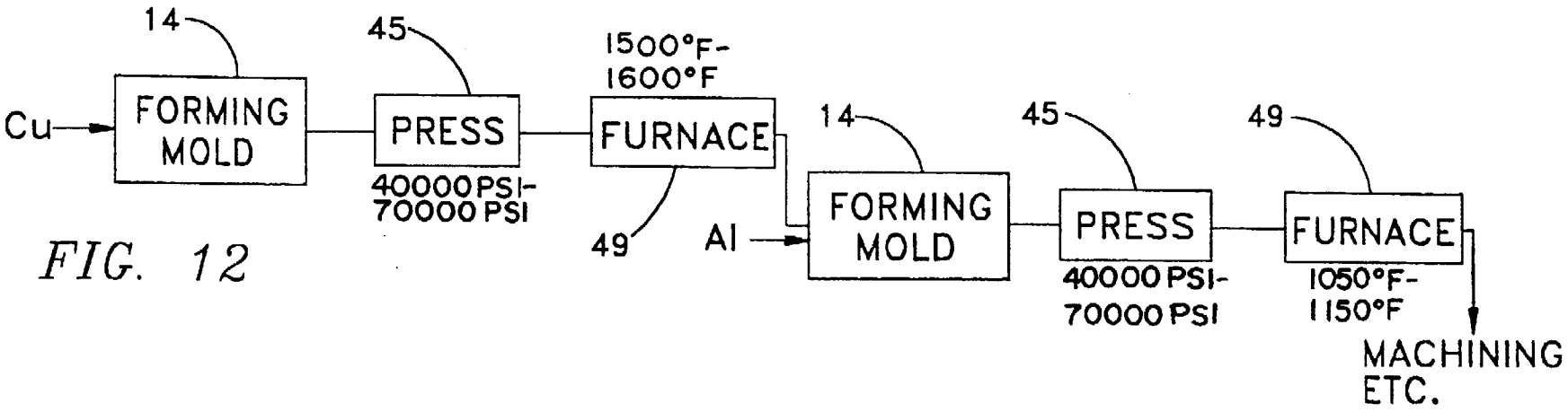
FIG. 12 is a block diagram for forming a cylinder of a preformed sintered Cu cylinder and Al powder.

It is to be understood that although the above discussion has been directed to the combination of an iron based metals other than iron based metals may be resorted to. Aluminum and Copper, for example, may be combined to form an Al/Cu cylinder in the manner and by the apparatus described herein (FIG. 12). When forming such an Al/Cu cylinder, Cu powder is placed in forming mold 14 and compacted by press 45 at about 40,000–70,000 PSI (preferably 60,000

PSI). The compacted cylinder is then sintered at about 1500°–1650° F. The compacted, and sintered cylinder is then cooled and placed in molding tool 14 and powdered Al is then added to form two contiguous columns. One column is the sintered Cu cylinder and the second column is powdered Al. The molding tool 14 is then placed in the press and pressurized at about 40,000–70,000 PSI (preferably 60,000 PSI) to compact the powdered Al and to bond the powdered Al to the Cu cylinder. The cylinder is then placed in furnace 49 where it is sintered at about 1050°–1150° F. (preferably 1100° F.) for about 10–15 minutes. It is to be understood that the powdered Al may be bonded to the interior or exterior surface of the Cu cylinder, as desired.

Figure 13:
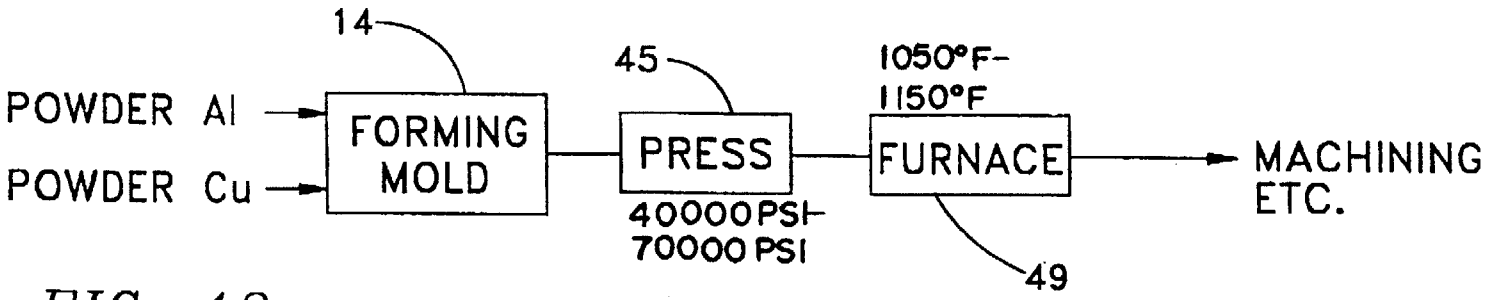
FIG. 13 is a block diagram for forming a cylinder of powder Cu and powder Al.

Powdered Al and powdered Cu may also be resorted to forming an Al/Cu cylinder instead of relying on the formed Cu cylinder as one component (FIG. 13). In such a case it is necessary to fill the molding tool 14 with diverse contiguous annular columns of the powder Al and powdered Cu as discussed above. The powdered Al and powdered Cu columns are then compacted in press 45 at a pressure of 40,000–70,000 PSI (preferably 60,000 PSI) and is then sintered at about 1050°–1150° F. for about 10–20 minutes to complete the bonding process. The sintered cylinder is then allowed to cool.

Figure 14:
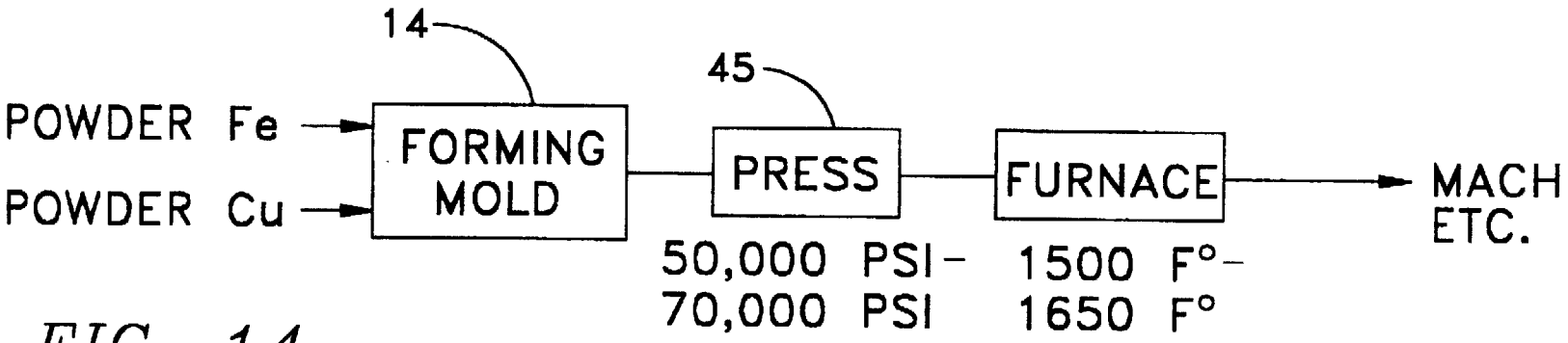
FIGS. 14 is a block diagram for forming a cylinder of powdered Fe and powdered Cu.

Powdered Fe and powdered Cu (FIG. 14) may be utilized in forming a Fe/Cu cylinder, if desired. This is accomplished by filling the molding tool 14 with diverse contiguous columns of Fe and Cu in the manner discussed above. The powdered Fe and Cu columns are then compacted in press 45 at a pressure of 50,000–70,000 PSI (preferably 60,000 PSI) and then sintered at about 1050°–1150° F. for a period of 20–60 minutes. The sintered cylinder is then allowed to cool.

It is to be understood that the cylinder may be made in various configurations. The external wall of the cylinder may be curved, if desired. Also configurations such as spaced ridges, flanges, criss-cross patterns, or spiral patterns may be provided on the external wall of the cylinder. To provide such configurations it is only necessary to provide the inner surface of the elastomeric member of the forming mold with the inverse configurations of the desired shapes.

It is to be further understood that although Cu, Fe, Al etc. has been used in describing the metals of the cylinder, various alloys of these metals may be resorted to, if desired.

It is yet to be further understood that in each of the above described embodiments of the present invention mechanical bonding between the contiguous metal columns are achieved because of grain interlocking between the two adjacent columns responsive to the compacting and sintering process.

We claim:

1. Apparatus for forming a cylindrical member from powdered metal material comprising:

a molding tool having a mandrel and a pressurizable elastomeric member mounted circumferentially about said mandrel to form a single annular forming chamber;

a rotatable table having a plurality of molding tool support positions spaced therearound for sequentially rotating through a molding tool filling station at which said molding tool is filled with said powdered metal material, a pressurization station at which said molding tool is pressurized to bond said powdered metal materials and thereby form said cylindrical member, a removal station at which said cylindrical member is removed from said molding tool for sintering thereof, and a cleaning station at which said molding tool is cleaned;

a pressure vessel mounted in spaced relation above said table;

first support means carried at each said molding tool support position for supporting a said molding tool thereon on said table;

second support means mounted adjacent said table at said pressurization station to receive and support said molding tool thereon;

first molding tool displacement means disposed for horizontal reciprocal movement to move said molding tool from said table to said second support means and back to said table;

actuator means for reciprocal movement of said first molding tool displacement means; and second molding tool displacement means for vertical reciprocal movement of said molding tool at said pressurization station to raise said molding tool into said pressure vessel for pressurization of said molding tool and to lower said molding tool down from said pressure vessel, whereby said first molding tool displacement means moves said molding back onto said table so that said molding tool may be sequentially moved to said tool removal and cleaning stations.

2. Apparatus as in claim 1 including feeder means for feeding said powdered metal into said annular chamber of said molding tool.

3. Apparatus as in claim 2 wherein said first support member includes a support plate for supporting said molding tool thereon, said support plate having a first arm extending therefrom, said actuator means having a second arm extending therefrom, said first and second arms being disposed for releasably attached relation.

4. Apparatus as in claim 3 including means for attaching said first and second arms in the releasably attached relation.

5. Apparatus as in claim 1 including feeder means for feeding said powdered metal into said chamber of said molding tool.

6. Apparatus as in claim 5 wherein said feeder means is positioned above said table, said apparatus including means for vertically raising said molding tool from a first downwardly retracted position to an upwardly extended position adjacent said feeder means and back to said retracted position.

7. Apparatus as in claim 2 wherein said feeder means includes a valve assembly including a first outer annular wall, a second intermediate annular wall and a third inner annular wall, said walls enclosing first and second powdered metal receiving cavities therebetween.

8. Apparatus as in claim 7 including means for vertically moving said first outer annular wall to permit said powdered metals in said first and second cavities to flow from said valve assembly.

9. Apparatus as in claim 8 including means for varying the height of said molding chamber during flow of said powdered metals therein to produce a pair of contiguous powdered metal columns.

* * * * *